US008303394B2

(12) United States Patent
Englman et al.

(10) Patent No.: US 8,303,394 B2
(45) Date of Patent: Nov. 6, 2012

(54) GAMING SYSTEM HAVING COMMUNITY GAMES WITH ENHANCED INDIVIDUAL OUTCOMES

(75) Inventors: Allon G. Englman, Chicago, IL (US); Joel R. Jaffe, Glenview, IL (US)

(73) Assignee: WMS Gaming Inc., Waukegan, IL (US)

( * ) Notice: Subject to any disclaimer, the term of this patent is extended or adjusted under 35 U.S.C. 154(b) by 261 days.

(21) Appl. No.: 12/740,771

(22) PCT Filed: Nov. 7, 2008

(86) PCT No.: PCT/US2008/012560

§ 371 (c)(1), (2), (4) Date: Apr. 30, 2010

(87) PCT Pub. No.: WO2009/061463

PCT Pub. Date: May 14, 2009

(65) Prior Publication Data

US 2010/0267439 A1 Oct. 21, 2010

Related U.S. Application Data

(60) Provisional application No. 61/002,750, filed on Nov. 9, 2007.

(51) Int. Cl.
*A63F 9/24* (2006.01)

(52) U.S. Cl. ..... 463/16; 463/20; 463/25; 463/29

(58) Field of Classification Search ..... 463/16
See application file for complete search history.

(56) References Cited

U.S. PATENT DOCUMENTS

| | | | | |
|---|---|---|---|---|
| 6,364,314 | B1 | 4/2002 | Canterbury | |
| 7,662,040 | B2 | 2/2010 | Englman et al. | |
| 7,780,520 | B2 * | 8/2010 | Baerlocher | 463/25 |
| 2006/0009283 | A1 * | 1/2006 | Englman et al. | 463/29 |
| 2006/0073880 | A1 | 4/2006 | Thomas | |
| 2006/0073897 | A1 | 4/2006 | Englman et al. | |
| 2006/0135243 | A1 | 6/2006 | Englman et al. | |
| 2006/0189378 | A1 | 8/2006 | Aoki | |
| 2006/0217173 | A1 | 9/2006 | Walker et al. | |
| 2006/0287043 | A1 | 12/2006 | Englman et al. | |
| 2007/0111785 | A1 | 5/2007 | Olive | |

(Continued)

OTHER PUBLICATIONS

International Search Report mailed Feb. 12, 2009 for PCT/US2008/012560, 2 pages.

*Primary Examiner* — Omkar Deodhar
(74) *Attorney, Agent, or Firm* — Nixon & Peabody LLP

(57) ABSTRACT

A gaming system comprises at least one wager input device, a plurality of gaming devices each displaying at least one primary wagering game, and a community display for displaying a community game. At least one controller is operative, in response to a triggering event, to (i) determine which of the plurality of gaming devices are eligible for participation in the community game, (ii) determine an individual award for each of the eligible gaming devices, (iii) determine a community award in the community game, (iv) select an individual award enhancement from a plurality of available individual award enhancements, (v) select one of the plurality of gaming devices to receive the selected individual award enhancement, and (vi) if the selected gaming device is eligible for participation in the community game, enhance the determined individual award for the selected gaming device with the selected individual award enhancement.

24 Claims, 9 Drawing Sheets

U.S. PATENT DOCUMENTS

2007/0155472 A1 7/2007 Gail et al.
2009/0093298 A1 4/2009 Michel
2010/0029367 A1 2/2010 Englman et al.
2010/0041464 A1 2/2010 Arezina et al.
2010/0056261 A1 3/2010 Englman et al.

* cited by examiner

300

GAMING SYSTEM HAVING COMMUNITY GAMES WITH ENHANCED INDIVIDUAL OUTCOMES

CROSS-REFERENCE To RELATED APPLICATIONS

This application is a U.S. national stage of International Application No. PCT/US2008/012560, filed Nov. 7, 2008, which is related to and claims the benefit of U.S. Provisional Application No. 61/002,750, filed Nov. 9, 2007, each of which is hereby incorporated by reference herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming system having community games with enhanced individual outcomes.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming systems with new types of bonus games to satisfy the demands of players and operators.

The present invention is directed to a gaming system having community games with enhanced individual outcomes.

SUMMARY OF THE INVENTION

According to one aspect of the present invention, a gaming system comprises at least one wager input device, a plurality of gaming devices each displaying at least one primary wagering game, and a community display for displaying a community game. At least one controller is operative, in response to a triggering event, to (i) determine which of the plurality of gaming devices are eligible for participation in the community game, (ii) determine an individual award for each of the eligible gaming devices, (iii) determine a community award in the community game, (iv) select an individual award enhancement from a plurality of available individual award enhancements, (v) select one of the plurality of gaming devices to receive the selected individual award enhancement, and (vi) if the selected gaming device is eligible for participation in the community game, enhance the determined individual award for the selected gaming device with the selected individual award enhancement.

According to another aspect of the invention, a method of operating a wagering game comprises receiving at least one primary wager, displaying at least one primary wagering game on a plurality of gaming devices, and displaying a community game. The method further comprises selecting one of the plurality of gaming devices to receive a selected award enhancement, selecting the selected award enhancement from a plurality of available award enhancements, and enhancing an individual award for the selected gaming device by the selected award enhancement. The method further comprises determining a community award in the community game, and providing a player of the selected gaming device a total award, the total award a function of the enhanced individual award and the community award.

According to yet another aspect of the invention, a method of operating a wagering game comprises detecting an occurrence of a triggering event, and in response to the triggering event, selecting an award enhancement from a plurality of available award enhancements. The method further comprises selecting a recipient gaming device from a plurality of gaming devices in a gaming system, determining an individual award for the recipient gaming device, and enhancing the individual award with the selected award enhancement.

According to yet another aspect of the invention, a gaming system comprises at least one wager input device, a plurality of gaming devices each displaying at least one primary wagering game, and a community display for displaying a community game. At least one controller is operative, in response to a triggering event, to (i) determine which of the plurality of gaming devices are eligible for participation in the community game, (ii) determine an individual award for each of the eligible gaming devices, (iii) determine a community award in the community game, (iv) select an individual enhancement booster from a plurality of available individual award enhancement boosters, (v) select one of the plurality of gaming devices to receive the selected individual enhancement booster, and (vi) if the selected gaming device is eligible for participation in the community game, boost the determined individual enhancement for the selected gaming device with the selected individual enhancement booster.

According to yet another aspect of the invention, a computer readable storage medium is encoded with instructions for directing a gaming system to perform the above methods.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
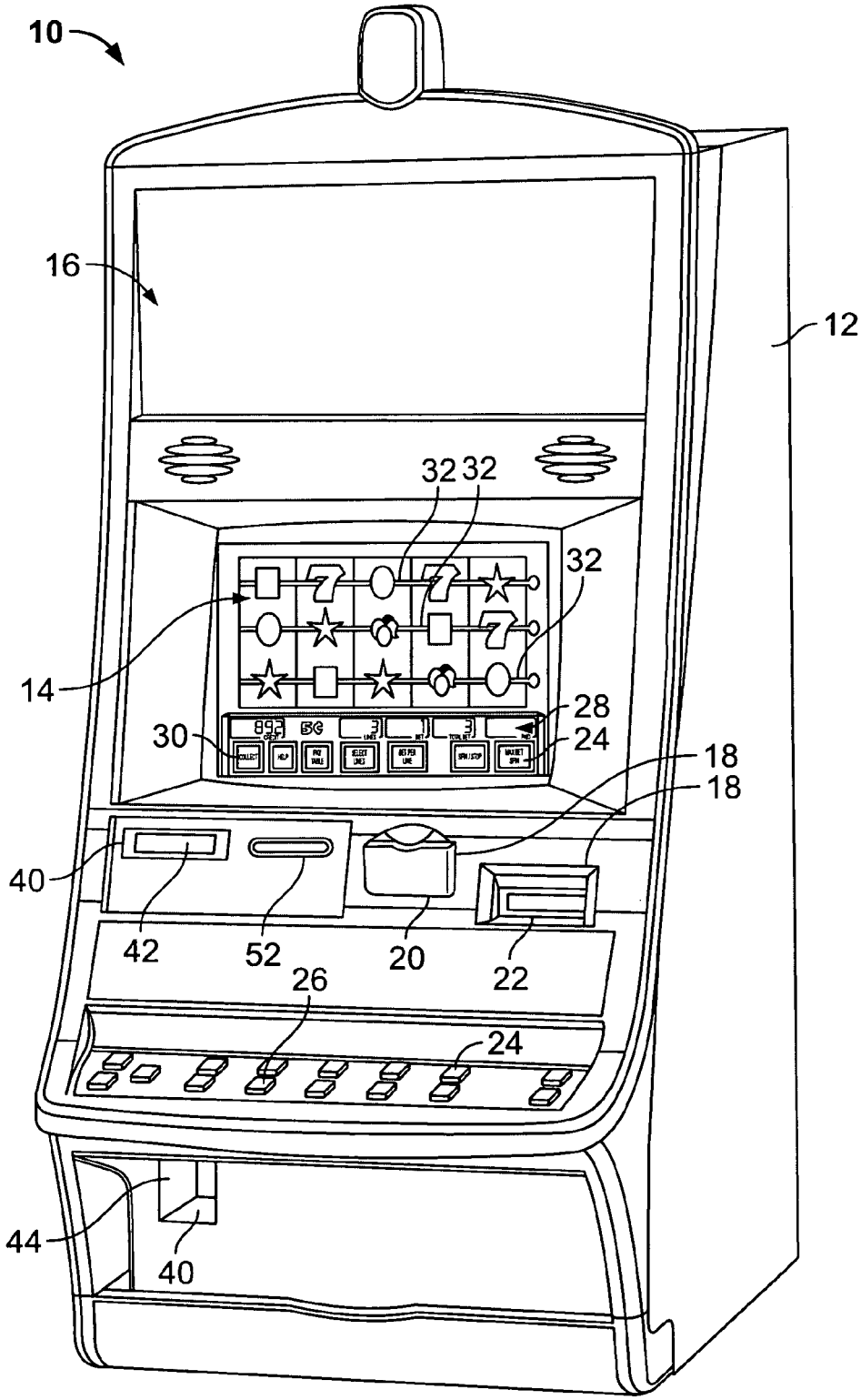
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a,* a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, any other game compatible with a display comprising at least one symbol-bearing reel strip. The gaming machine 10 may also be a hybrid gaming machine integrating both electronic and electromechanical displays.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 of the gaming machine 10 may include a number of mechanical reels to display the outcome in visual association with at least one payline 32. Alternatively, the primary display 14 may take the form of a hybrid display incorporating both electromechanical display components, such as reels, with an electronic display, which may include a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
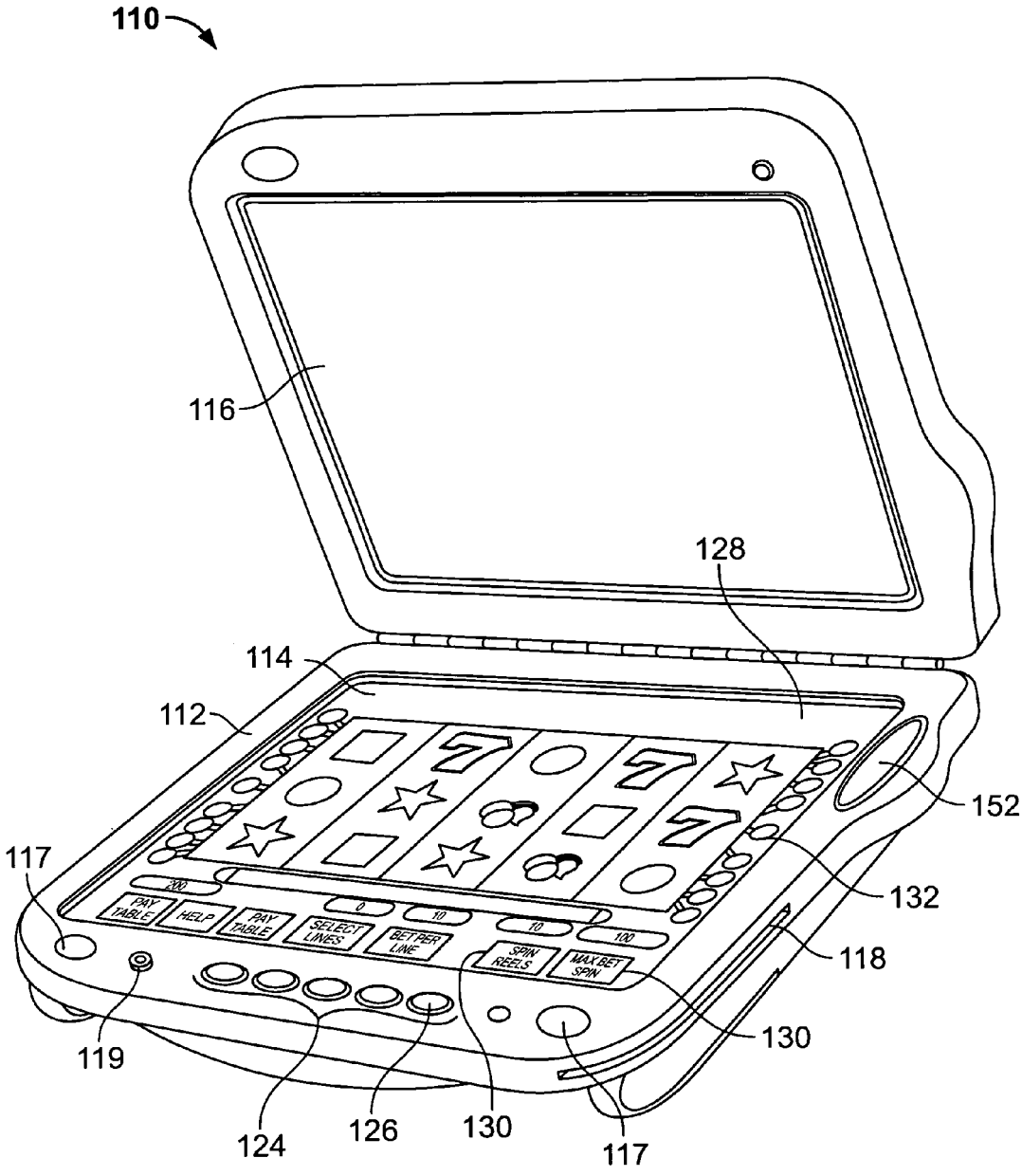
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electromechanical gaming machine configured to play mechanical slots, any other game compatible with a display comprising at least one symbol-bearing reel strip. The handheld gaming machine 110 may also be a hybrid gaming machine integrating both electronic and electromechanical displays. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons 126 may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably includes a number of mechanical reels to display the outcome in visual association with at least one payline. Alternatively, the primary display 114 may take the form of a hybrid display incorporating both electromechanical display components, such as reels, with an electronic display, which may include a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 118 or an assignment of credits stored on the handheld gaming machine via the player input device 124, e.g. the touch screen keys 130 or push buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
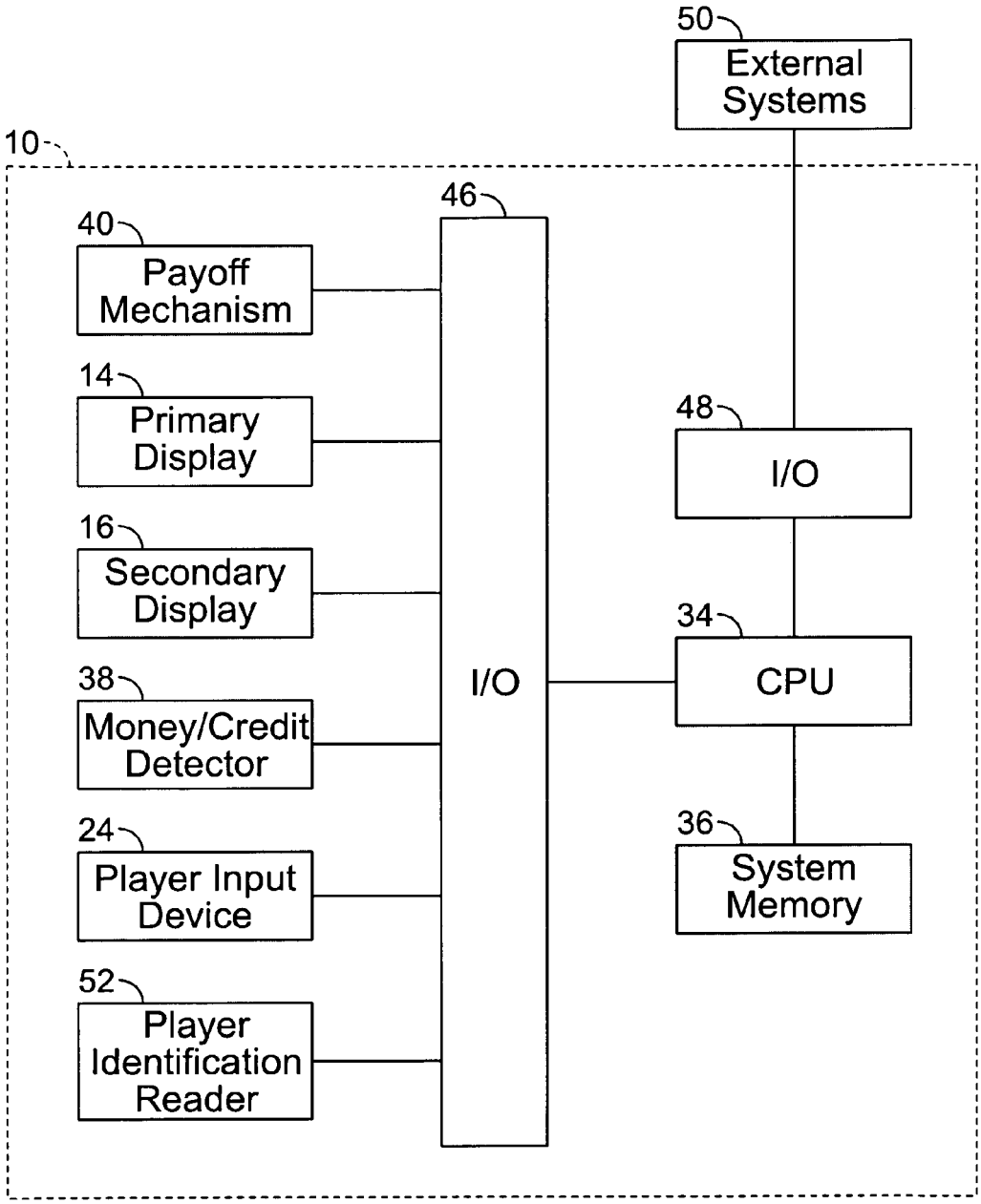
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality there between. As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "thicker client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
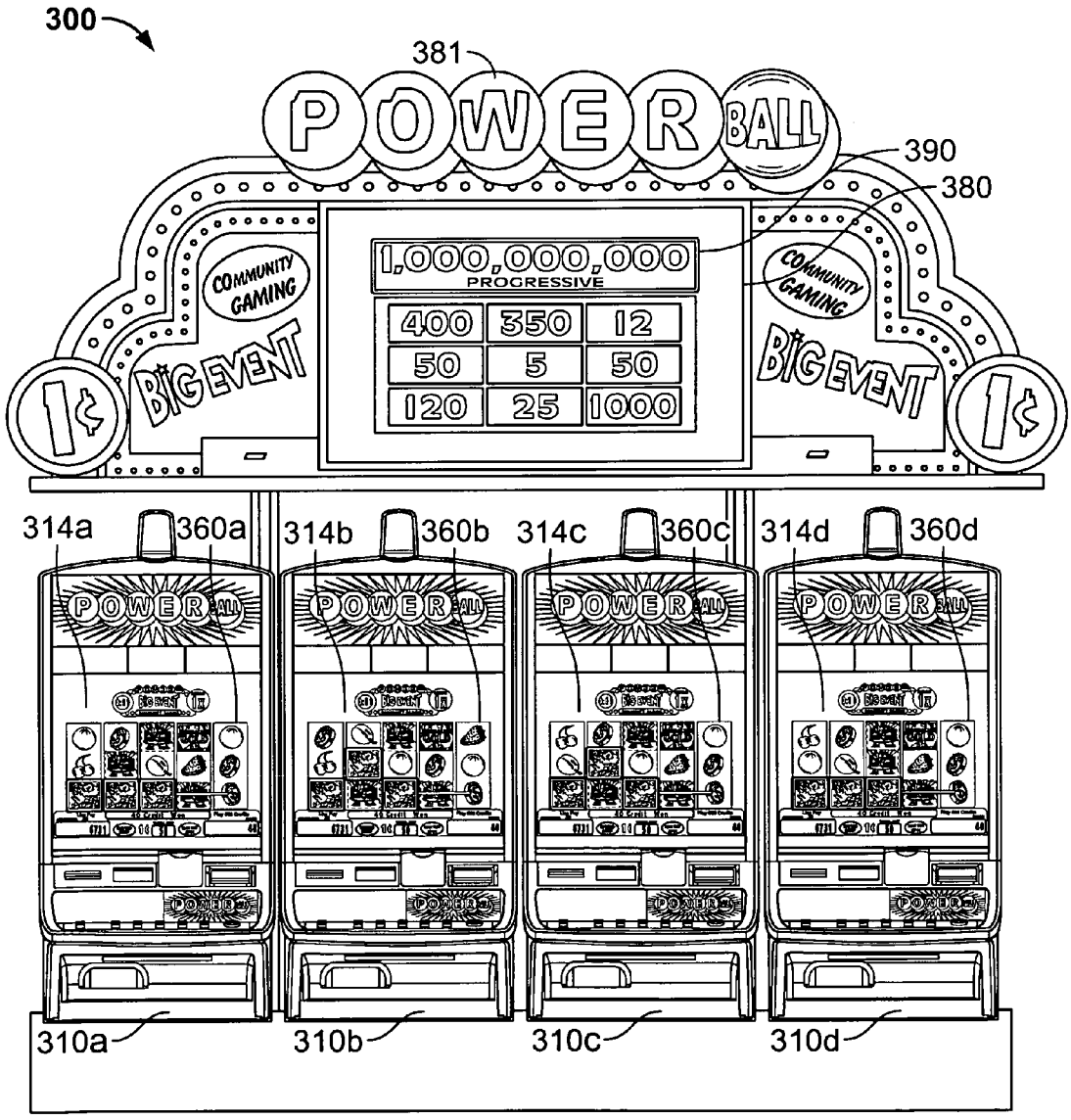
FIG. 3 is a diagram of a gaming system including a community game having enhanced individual outcomes.

Turning now to FIG. 3, a gaming system 300 is depicted which comprises a plurality of gaming devices 310*a,b,c,d* and at least one community display 380 for depicting and displaying community games 390 and other gaming events. The plurality of gaming devices 310*a,b,c,d* may include free-standing gaming devices such as the one depicted and described with reference to FIG. 1*a,* handheld gaming devices such as the one depicted and described with reference to FIG. 1*b,* or any combination of the two. Each of the gaming devices 310*a,b,c,d* is in communication with the community display 380, so as to be able to participate in community games 390 displayed thereon provided certain eligibility criteria are satisfied. Each of the gaming devices 310*a,b,c,d* includes at least a primary display 314*a,b,c,d* and displays at least one primary wagering game 360*a,b,c,d* thereon. In the embodiment shown, the community game 390 is a "Powerball Big Event" game in which players at the various gaming devices 310*a,b,c,d* are able to participate if satisfying eligibility criteria. In addition to the community display 380, the system 300 may include other displays or signage 381 which add to the visual appeal, decoration, and entertainment of the community display 380. The signage 381 may include other displays, lighting, graphics, or other elements of visual interest.

Figure 4:
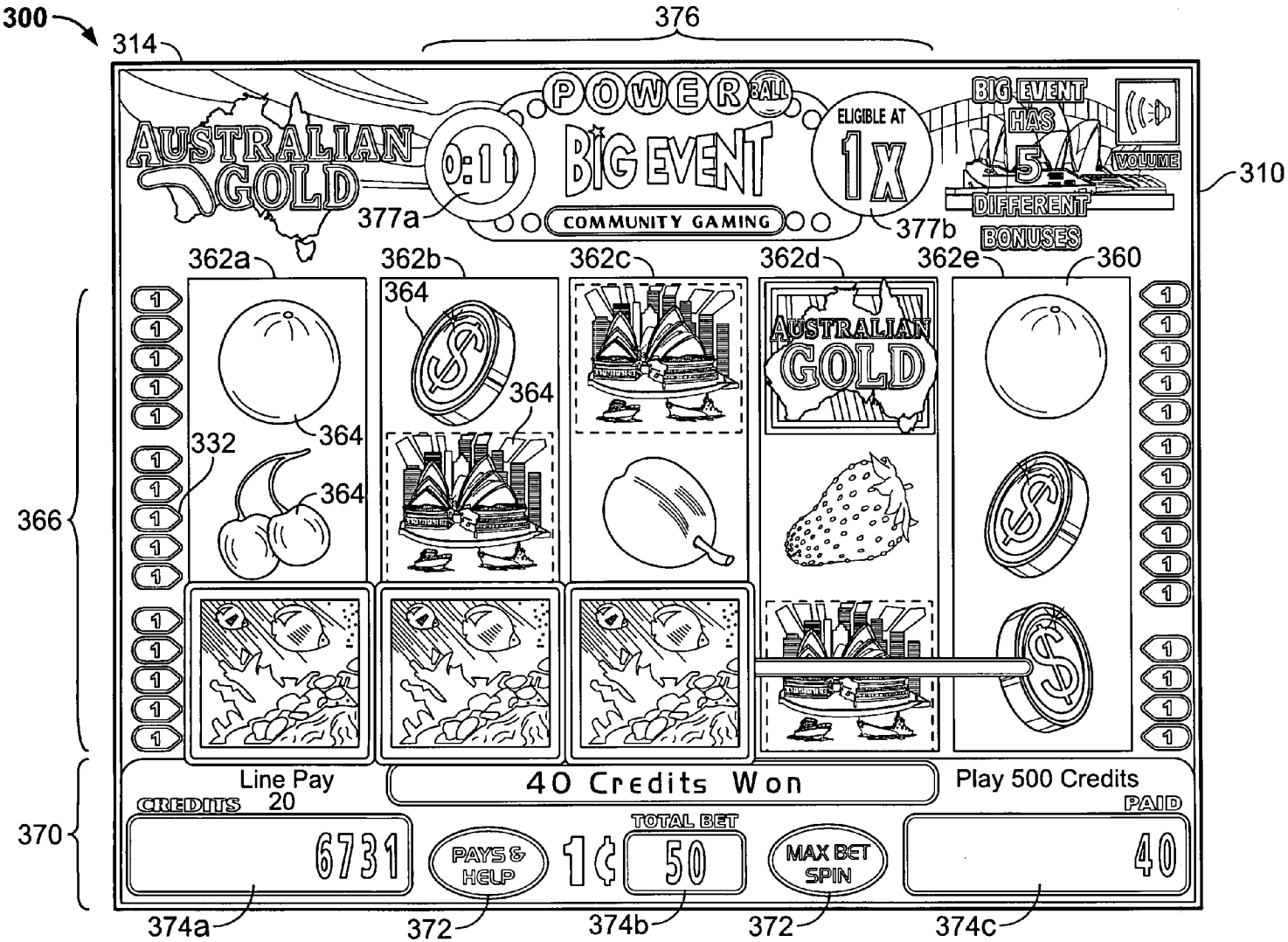
FIG. 4 is a screen shot of a primary wagering game of the gaming system of FIG. 3.

Turning to FIG. 4, a primary display 314 of one of the gaming devices 310 of the gaming system 300 of FIG. 3 is shown. The primary display 314 may be any form of display such as those described herein with reference to the free standing and handheld gaming devices of FIGS. 1*a* and 1*b*. The primary display 314 includes display of a primary wagering game 360, which in this embodiment is a slot game as shown in FIG. 3. The slot game 360 includes a plurality of reels 362*a,b,c,d,e* which may be either electro-mechanical reels or simulations thereof on the primary display 314. The reels 362*a,b,c,d,e* include a plurality of symbols 364 displayed thereon which vary as the reels 362*a,b,c,d,e* are spun and stopped. The symbols 364 may include any variety of graphical symbols, elements, or representations, including symbols 364 which are associated with one or more themes of the gaming machine or system. The symbols 364 may also include a blank symbol or empty space. As described herein, the symbols 364 landing on the active paylines 332 (the paylines for which a wager has been received) are evaluated for winning combinations. If a winning combination of symbols 364 lands on an active payline 332, a primary award is awarded in accordance with a pay table of the gaming device. The symbols 364 on the reels 362*a,b,c,d,e* form an array 366 or matrix of symbols 364, having a number of rows and columns, which in the embodiment shown is three rows and five columns. In alternate embodiments, the array 366 may have greater or fewer symbols 364, and may take on a variety of different forms having greater or fewer rows and/or columns. The array 366 may even comprise other non-rectangular forms or arrangements of symbols 364.

A control bar 370 appears along the bottom of the display 314 and includes a plurality of input buttons or keys 372 for which inputs are sensed by a touch screen overlying the display 314. Moreover, a plurality of meters 374 are displayed on the control bar 370, including a Credit Meter 374*a,* a Total Bet Meter 374*b,* and a Paid Meter 374*c*. The Credit Meter 374*a* displays the number of credits available to a player based upon coin, currency or other value input into the system 300. The Total Bet Meter 374*b* displays the total wager on a single play of the wagering game 360, which is the product of the bet amount per line times the number of activated paylines 332. The Paid Meter 374*c* displays how many credits, if any, have been awarded to the player as a result of a winning outcome on a single play of the primary wagering game 360. If a winning outcome is achieved, the Paid Meter 374*c* displays the size of the win in credits, after which the credits are transferred to the player's balance in the Credit Meter 374*a,* and the Paid Meter 374*c* is reset to zero for a subsequent play of the primary wagering game 360.

The primary display 314 further displays an eligibility meter 376. The eligibility meter 376 includes display of a remaining eligibility time 377*a* (0:11 seconds), and a multiplier 377*b* (1×), as seen in FIG. 4. As a player commences successive plays of the wagering game 360 by pressing the Spin button at the bottom of the display 314 (or other appropriate input device), the player's remaining eligibility time 377*a* is increased. In an embodiment, the faster a player plays the primary wagering game 360, the faster eligibility time 377*a* is added to the eligibility meter 376. Moreover, in an embodiment, the faster a player plays the primary wagering game 360, the faster the player's multiplier 377*b* level on the eligibility meter 376 increases. In an embodiment, the player's eligibility time 377*a* and multiplier 377*b* are incremented as described in PCT Patent Publication WO 2006/121663, and U.S. Published Patent Application 2006/0135243, both of which are assigned to WMS Gaming Inc., and incorporated herein by reference in their entirety as if full set forth herein. During each play of the wagering game 360, the time eligibility meter 377*a* is increased in an amount corresponding to and dependent upon (i) the size of the primary wager, (ii) the rate of play of the primary wagering game 360, or both. The time eligibility meter 377*a* may include a plurality of multiplier levels such that the meter 376 displays both a running time meter clock and a current multiplier level 377*b*. Moreover, as time eligibility 377*a* is accumulated in the meter 376, the multiplier levels 377*b* may increase, and as time eligibility 377*a* is expended through decrementing of the meter 376, the multiplier levels 377*b* may decrease, as described therein.

In an embodiment, during play of the primary wagering game 360, a fixed amount of time is added to the time eligibility meter 377*a* for each spin or activation of the primary wagering game 360. For example, the time interval added to the meter 377*a* may be 7 seconds for each spin or play of the primary wagering game 360. In an embodiment, for each second that a player does not play the primary wagering game 360, a corresponding amount of time (1 second, for example) may be removed or allowed to decay off of the time eligibility counter 377*a*. The player continues play of the primary wagering game 360 until a triggering event occurs which triggers the community game 390. In one embodiment, the triggering event is a randomly selected event. In other embodiments, the triggering event may be the occurrence of a certain outcome in the primary wagering game 360. In yet other embodiments, the triggering event may be threshold based, time based, or may be based on other factors.

Figure 5:
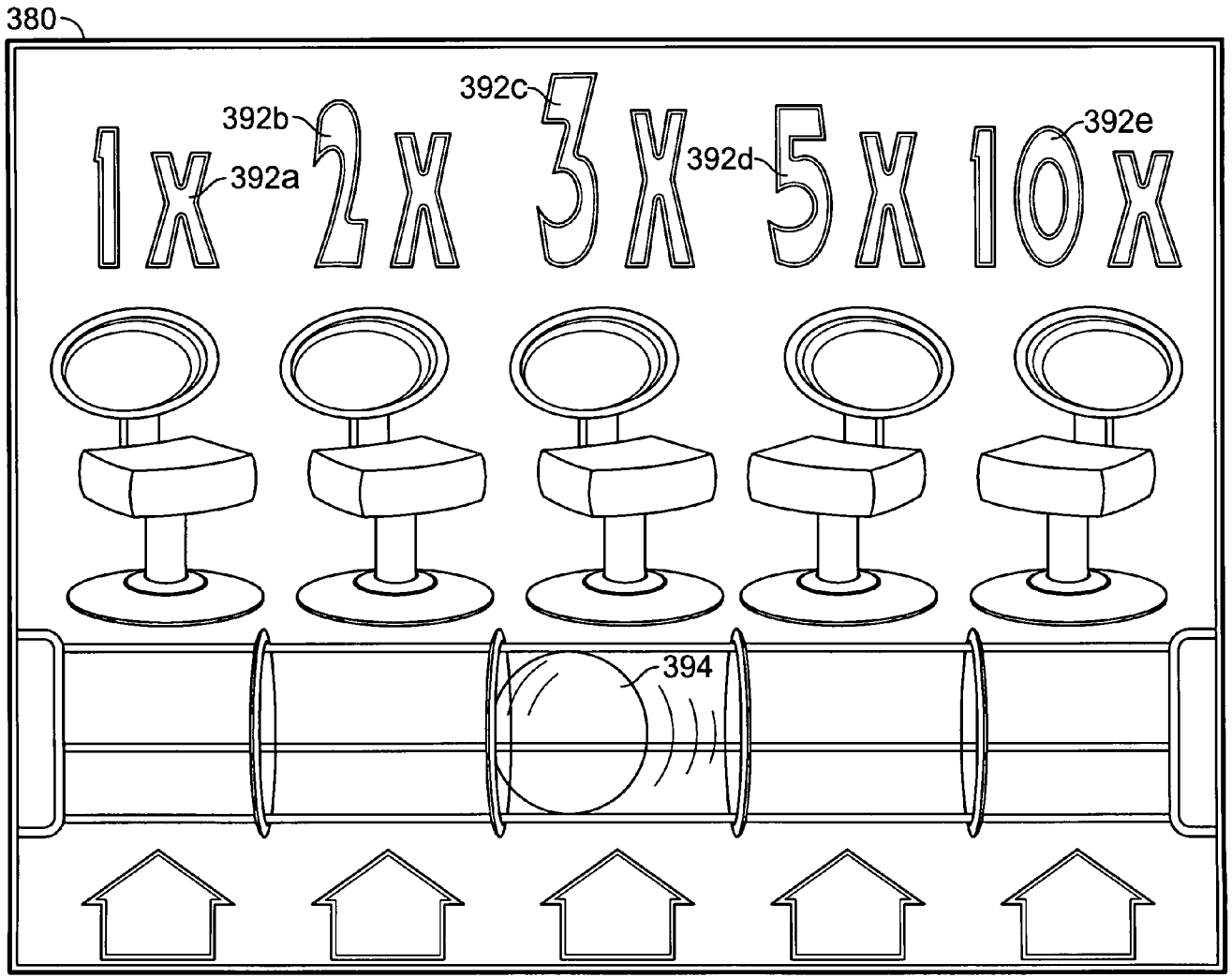
FIG. 5 is a screen shot of a community display of the gaming system of FIG. 3 depicting a selection event.

Turning to FIG. 5, upon the occurrence of a triggering event, the community game 390 is triggered. Prior to the display of the community game 390 on the community display 380, an enhancement or booster is selected and provided to one of the gaming devices 310*a,b,c,d* in the system 300. Thus, FIG. 5 displays the community display 380 prior to the start of the community game 390, in which the enhancement or booster is about to be selected and distributed to one of the gaming devices 310*a,b,c,d*. The community display 380 displays a plurality of enhancements or boosters 392*a,b,c,d,e* and at least one selector 394. In the embodiment shown, the enhancements 392*a,b,c,d,e* are additional multipliers to be provided to one or more players. The selector 394 in this embodiment is a ball (or "Powerball") which moves horizontally in a tube. The selector 394 is used to graphically indicate the selected enhancement from the plurality of available enhancements 392*a,b,c,d,e*.

Figure 6:
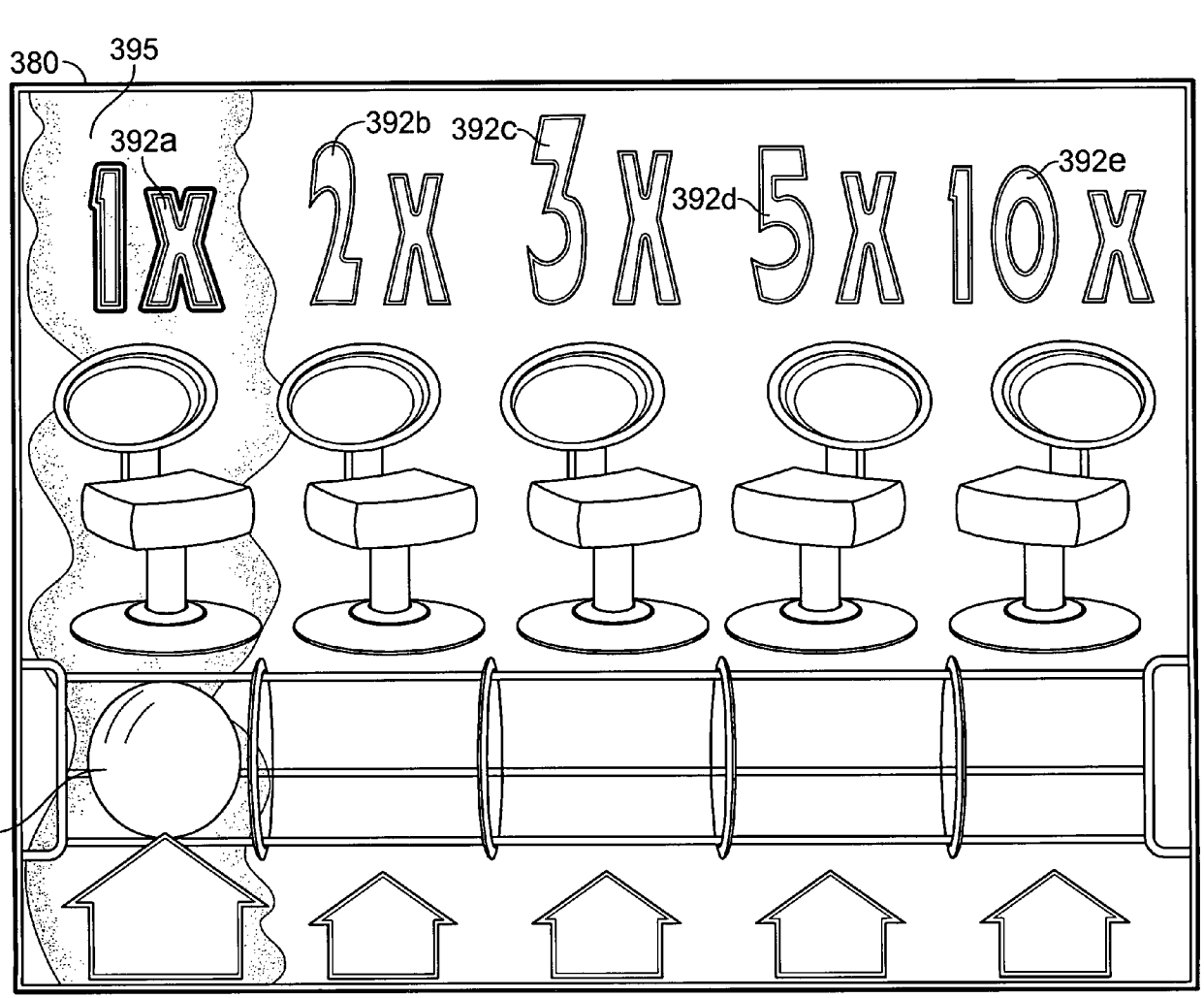
FIG. 6 is a further screen shot of the community display of FIG. 4 depicting selection of a gaming device to be enhanced.

In FIG. 6, the community display 380 is again shown wherein the selector 394 is in the process of indicating the selected enhancement 392*a* from the plurality of available enhancements 392*a,b,c,d,e*. In this embodiment, the selector 394 ball moves back and forth in the tube to create anticipation until the ball finally comes to rest at a location in the tube which is in vertical alignment (and thus associated with) the selected enhancement 392*a*. As seen in FIG. 6, the system 300 has selected the 1× multiplier to be the provided enhancement 392*a*, and thus the selector 394 ball has traversed the tube and stopped at a location underneath the 1× multiplier to signify that it is the selected enhancement 392*a*. An optional graphical selection animation 395 is displayed to further indicate that the 1× multiplier is the selected enhancement 392*a*. In this embodiment, the graphical selection animation 395 includes a highlighted flame moving upward from the selector 394 ball and up to the selected enhancement 392*a* of 1×. Moreover, the graphical selection animation includes enlargement of the arrow underneath the selector 394 ball.

In addition to selecting the enhancement, the system 300 selects at least one gaming device 310*a,b,c,d* of the system to receive the selected enhancement or booster 392*a*. The selection of the winning gaming device 310*a,b,c,d* may be accomplished in many ways. In one embodiment, the winning gaming device 310*a,b,c,d* (the one which will receive the selected enhancement 392*a*) may be randomly selected from the available gaming devices 310*a,b,c,d* without regard to whether the gaming devices 310*a,b,c,d* are being played or not. One or more controllers (not shown) of the system 300 may be employed to select the gaming device 310 of the system 300 to receive the selected enhancement 392*a*. In an embodiment, if the selected gaming device 310 is not being played at the time, it still receives the selected enhancement 392*a* so as to provide additional excitement and anticipation to other players through a "near miss" scenario. In an alternative embodiment, only gaming devices 310 which are currently being played are eligible to receive the selected enhancement 392*a*. In yet other alterative embodiments, other eligibility criteria may be used to determine which gaming devices 310 are eligible to receive the selected enhancement 392*a*.

Figure 7:
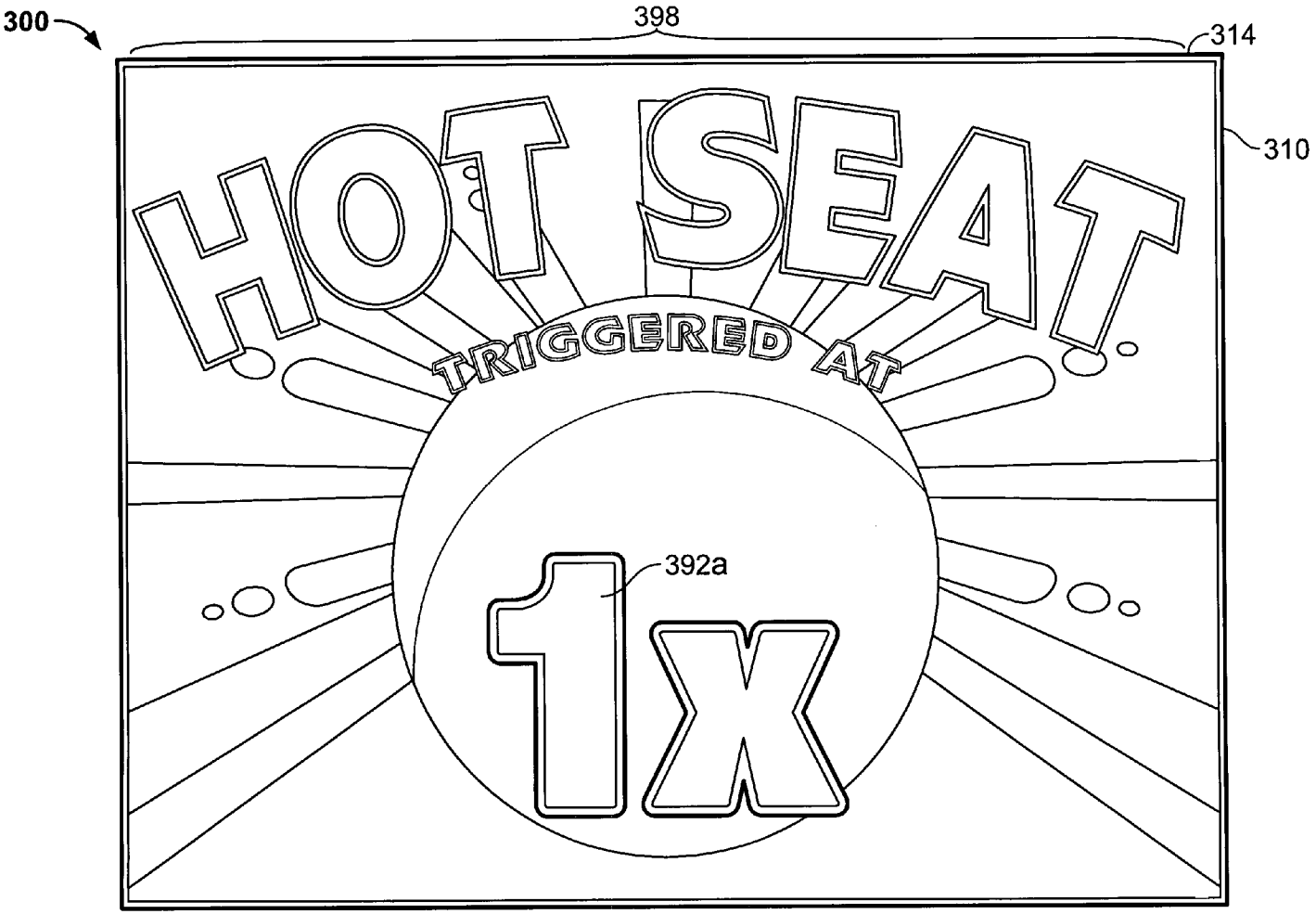
FIG. 7 is a further screen shot of the community display of FIG. 5 depicting the awarded enhancement.

In FIG. 7, the primary display 314 of the selected gaming device 310 of the system 300 is shown. A brief award animation is displayed on the primary display 314 so as to indicate to the player at the gaming device 314 (or other players nearby) that the particular gaming device 310 in question has been selected to receive a selected enhancement 392*a*. As seen in FIG. 7, the primary display 314 includes an information message 398, which reads "Hot Seat Triggered At . . . ", and further displays and reveals the selected enhancement 392*a*, which on this play is an additional multiplier of 1×. Thus, the information message 398 is used to communicate to the players that the particular gaming machine 310 is the selected recipient of an individual enhancement, and to further reveal the nature and value of that selected enhancement 392*a*.

Figure 8:
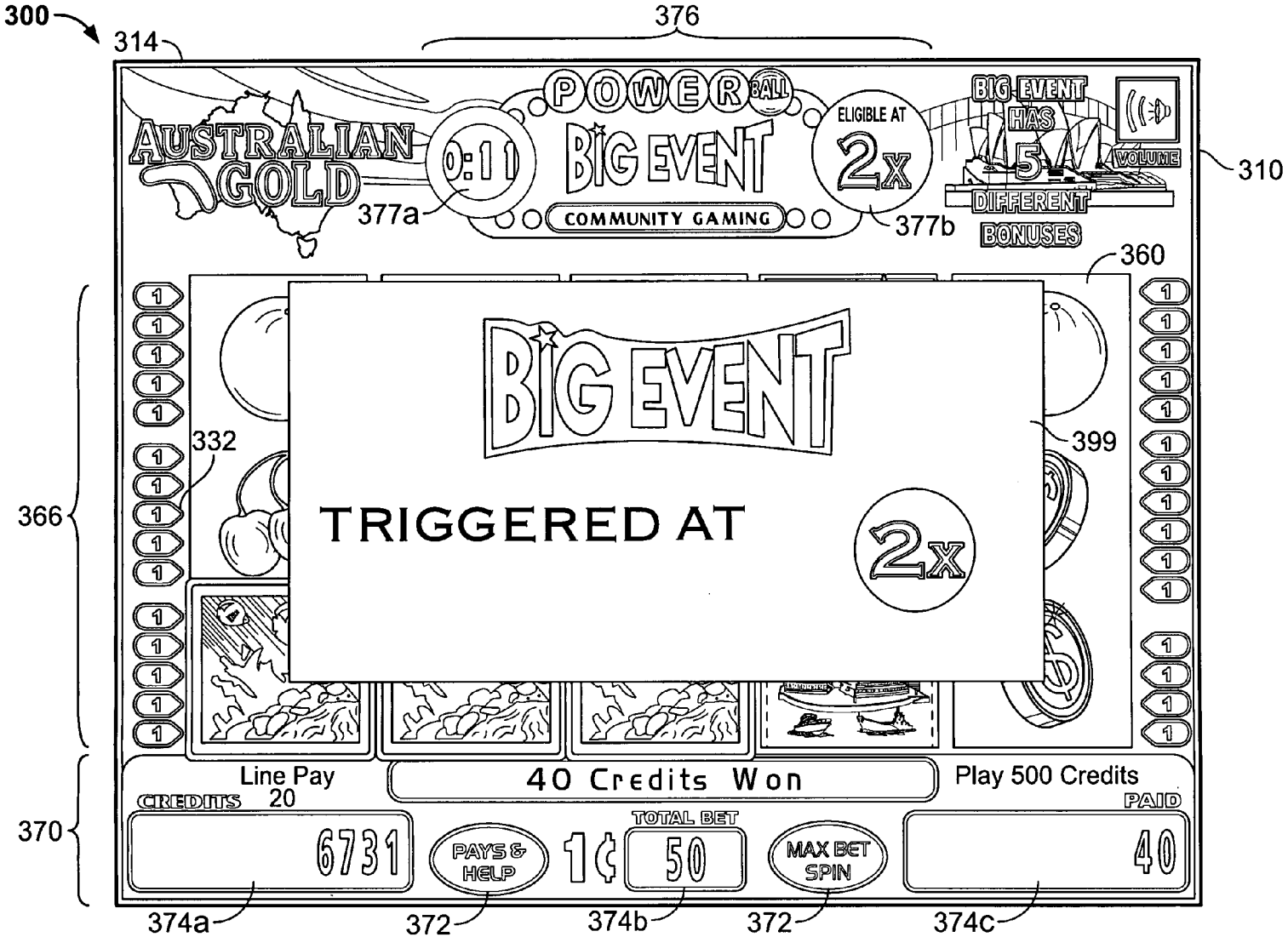
FIG. 8 is a further screen shot of the primary wagering game of FIG. 4, depicting application of the selected enhancement.

Turning to FIG. 8, the primary display 314 of the selected gaming device 310 is shown following the award animation of FIG. 7. The primary display 314 returns to displaying the primary wagering game 360 and eligibility meter 376. A pop up window 399 overlies the primary wagering game 360 and announces that the "Big Event Triggered at 2×." This reveals to the player that the community wagering game 390 (Big Event) has been triggered, and also reveals to the player the individual portion of such community game 390 (in this case, a multiplier of 2×). The individual portion on this selected gaming device 310 has been increased as a result of the selected enhancement 392*a*. Thus, in FIG. 4, at the time the Big Event community game 390 was triggered, the player's individual portion or individual award (in this case a multiplier) was 1×. However, through the operation of the selection of an enhancement and a recipient of the enhancement as described herein, the selected gaming device shown in FIG. 7 has been awarded an additional 1× multiplier as the selected enhancement 392*a*, and thus the player of that gaming machine 310 enters the Big Event community game 390 with an increased or boosted individual portion or award (2× instead of his original 1×). Optionally, as seen in FIG. 8, the multiplier level 377*b* of the eligibility meter 376 may be updated to reflect the increased multiplier as a result of receipt of the selected enhancement 392*a*. Thus, in an embodiment, the system 500 selects a booster and boosts an individual enhancement achieved by the player.

In one embodiment, the player's individual portion or award may be an award (such as a credit amount) or may be an enhancement (such as a multiplier). The selected enhancement 392 may also be an award (such as a credit amount) or may be an enhancement or booster (such as a multiplier). In an embodiment where both the individual portion and the selected enhancement are enhancers (such as a multiplier), it may be referred to herein as a "booster". Thus, a selected enhancement which enhances an individual award or portion which is also an enhancement, may be referred to as a "booster" which "boosts" the individual enhancement. For example, selection of a 1× multiplier enhancement which is added to an individual award of a 1× multiplier to create a 2× multiplier may also be described as selection of a 1× booster which boosts the individual award of a 1× multiplier to a boosted award of 2×.

Once the community game 390 is triggered, it plays out to determine at least one community award. In an embodiment, the community game 390 involves selection of one of a plurality of progressive jackpots, as seen on the community display 380 in FIG. 3. In other embodiments, the community game 390 may take on many other forms, including a slot game, a board game, a selection game, a competition, a sporting event, a race, or virtually any other type of gaming event in which at least one community outcome and community award is determined. Upon conclusion of the community game, each player of the gaming devices 310*a,b,c,d* in the system 300 are awarded a total award which is based in part on the community award provided, and the individual portion of the award. In the embodiment shown and described, the individual portion is a multiplier which is multiplied with the community award to provide a total award for each player. As described, because the player's multipliers are based upon the size of their wagers and their rate of play in the primary wagering game 360, the total awards to each player upon conclusion of the community game 390 may differ significantly. However, because the player of the selected gaming device 310 received the selected enhancement 392*a,* he will receive a bonus award. Examples of such community games in which players are awarded total awards that are a function of both an individual portion or award, and a community portion or award, is described in U.S. Published Patent Application 2006/0135243, wherein the player's individual portion is referred therein as the player's value enhancing parameter to the community award.

In an embodiment, the selection of a gaming device 310 to receive a selected enhancement is entitled "hot seat" such that a particular gaming device 310 and chair associated therewith are determined to be a "hot seat" within the bank of gaming devices 310*a,b,c,d.* In an embodiment, the gaming devices 310*a,b,c,d* in the system 300 are arranged proximate one another in a "bank" such that the award of the selected enhancement 392 to one of the gaming devices 310 will be seen by other players at the bank, and thereby maximize anticipation and excitement. In other embodiments, the gaming devices 310 in the system may be arranged remotely from one another, or in any other appropriate arrangement.

In alternative embodiments, the steps of selecting an enhancement to be provided and selecting a recipient of the enhancement may be reversed. For example, in one alternative embodiment, upon the occurrence of a triggering event, a controller of the system 300 selects a recipient gaming device from a plurality of available (and eligible) gaming devices in the system. The selected gaming device may then provide a display of the selection of the enhancement to be provided. Thus, in one embodiment, the animation and graphical display of the selection of an enhancement to be provided may occur only on the primary display of the recipient gaming device, and not on a community display. Thus, for example, the selection depicted in FIGS. 5 and 6 may occur locally on a display of the recipient gaming device, and not on a community display or on other gaming devices not selected to be the recipient.

It should be understood that in an embodiment, a plurality of eligible gaming devices on the system may be permitted to participate in the community game, although only one (or some other predetermined number) gaming device which is selected to be the recipient of the selected enhancement receives such enhancement. Thus, in the embodiment shown in FIG. 4, where the system 300 comprises four gaming devices 310*a,b,c,d,* upon the occurrence of a triggering event, all four gaming devices 310*a,b,c,d* may participate in a community game 390 displayed on the community display 380. Each player at each gaming device 310*a,b,c,d* may commence the community game 390 with an individual portion, such as a multiplier 377*b* displayed on his or her eligibility meter 376. One of the players may receive a selected enhancement as described herein, however all of the players at eligible gaming devices 310*a,b,c,d* still participate in the community game 390. When a community award is determined in the community game 390, it is provided to each of the players whose total award is still determined as a function of both the community award and their individual portion. In an embodiment, the total award is the community award multiplied by the player's individual multiplier 377*b.*

In yet another alternative embodiment, when one of the enhancements 392*a* is selected from the group of enhancements 392, the selected enhancement 392*a* is multiplied with the individual portion already earned by the player in playing the primary wagering game 360. Thus, in the example shown in the FIGURES, when the triggering event occurs, if the player has a multiplier 377*b* of "1×" on his eligibility meter 376, and is the selected recipient of a selected enhancement 392*d,* for example "5×" in FIG. 6, then the player's total individual portion is the product of the "1×" and "5×", for a total individual portion of "5×." In another example, if the player's multiplier 377*b* on his eligibility meter 376 were 4× at the time of the triggering event, and he was selected to receive a selected enhancement 392*e* of 10×, for example in FIG. 6, then his total individual portion would be 40×. In this way, by multiplying the selected enhancement with the individual portion to determine the total individual portion, players who make larger wagers and play faster (thereby generating higher multipliers 377*b*) are rewarded even more by receiving significantly larger total individual portions.

In other embodiments, the enhancements provided may take on various other forms. For example, the enhancements may include additional selections in a selection game, credit amounts, special symbols, wild card symbols, upgrades of winning combinations, wild multipliers, expanding wild symbols, or any other form of enhancement. The enhancements are provided to enhance the player's individual portion of the total award. Thus, the selected enhancements, in an embodiment, do not affect the community award provided in the community game. In other embodiments, the enhancements may affect the community game as well. Moreover, it should be understood that the provided enhancements may, in alternative embodiments, be saved, transferred, banked, auctioned, traded, etc.

In an alternative embodiment, players of the gaming system 300 may be permitted to make a side wager or secondary wager on the result of the winner of the hot seat selected enhancement 392. For example, players may place a side wager and select a predicted credit range of the resulting total award awarded to the hot seat winner. Thus, for example, for a ten credit side wager, players can select from several tiers (0 to 1000 credits, 1001 to 2000 credits, 2001 to 3000 credits, and 3001 to 4000 credits, for example). If the selected gaming device 310 (the "hot seat" winner) receives a total award (the combination of the community award and the player's individual portion) which is within the player's selected range on his side bet, he is awarded an additional prize or award for the side wager. In other embodiments, players may be permitted to put side bets or side wagers on other players besides the "hot seat" winner.

In another embodiment, a player of the gaming system 300 having the highest individual portion (for example, the highest multiplier) may be provided some control or additional input and control of the community game 380 as a further award. Thus, for example, a player having the highest multiplier entering into the community game 380 may be permitted to control the speed of play of the community game 380, may be provided additional selections, spins, or other inputs into the community game 380, or may otherwise get preferential treatment in the play, display, execution, and culmination of the community game 380. The player with the highest individual portion (highest multiplier, for example) may be determined prior to the distribution of the enhancement described herein, or may be determined after the distribution of the selected enhancement. If selected after distribution of the selected enhancement, the player "in the lead" or having the highest multiplier when the community game triggering event occurs, may not end up being the player with the highest multiplier. For example, a player having a lower multiplier when the triggering event occurs may be provided with a selected enhancement (additional multiplier, for example) which pushes their total multiplier (individual portion) to be the highest of all of the gaming devices 310 in the system 300. Other evaluation techniques may be utilized as well to determine who, if anyone, is given special treatment relating to control, input, etc. of the community game 380 as described herein.

The systems and methods described herein offer a number of benefits and advantages over traditional gaming systems. By selecting a recipient (a "hot seat" winner) of a special selected enhancement, the gaming system of the present invention provides additional excitement and anticipation to players of the system and those observing the games played thereon. The players of the system participate in a community game in which a community award is provided and combined with an individual award or portion. Thus, the hot seat selection of an enhancement and recipient thereof provides an additional individual or specialized award. This is advertised and displayed to other players and gaming devices of the system, which inspires competitiveness and excitement in playing the game. This excitement and competitiveness in turn causes more plays of the game to occur, and thus greater revenues generated there from. Moreover, the recipient of the special enhancement receives special attention and recognition, which causes that player to feel special while receiving the enhancement, thereby causing a larger total award for that player.

Each of these embodiments and obvious variations thereof is contemplated as falling within the spirit and scope of the claimed invention, which is set forth in the following claims.

What is claimed is:

1. A gaming system comprising:

at least one wager input device;

a plurality of gaming devices each displaying at least one primary wagering game;

a community display for displaying a community game;

at least one controller operative, in response to a triggering event, to:

(i) determine which of the plurality of gaming devices are eligible for participation in the community game;

(ii) determine an individual award for each of the eligible gaming devices;

(iii) determine a community award in the community game;

(iv) select an individual award enhancement from a plurality of available individual award enhancements;

(v) select one of the plurality of gaming devices to receive the selected individual award enhancement; and (vi) if the selected gaming device is eligible for participation in the community game, enhance the determined individual award for the selected gaming device with the selected individual award enhancement.

2. The system of claim 1, wherein the at least one controller is further operative to:

(vii) for each of the eligible gaming devices, provide a total award comprising a combination of the determined individual award for each gaming device and the community award.

3. The system of claim 1, wherein the individual award for each of the eligible gaming devices is a multiplier.

4. The system of claim 3, wherein each of the plurality of available individual award enhancements is a multiplier.

5. The system of claim 4, wherein the selected individual award enhancement is a multiplier which is either added to or multiplied by the determined individual award for the selected gaming device.

6. The system of claim 1, wherein the selected individual award enhancement is randomly selected.

7. The system of claim 1, wherein the selected gaming device is randomly selected.

8. A method of operating a wagering game comprising:

receiving at least one primary wager;

displaying at least one primary wagering game on a plurality of gaming devices;

displaying a community game;

selecting one of the plurality of gaming devices to receive a selected award enhancement;

selecting the selected award enhancement from a plurality of available award enhancements;

enhancing an individual award for the selected gaming device by the selected award enhancement;

determining a community award in the community game; and providing a player of the selected gaming device a total award, the total award a function of the enhanced individual award and the community award.

9. The method of claim 8, wherein the individual award is a first multiplier.

10. The method of claim 9, wherein the first multiplier is determined as a function of (i) rate of play of the at least one primary wagering game on the selected gaming device, (ii) the size of one or primary wagers received, or both (i) and (ii).

11. The method of claim 9, wherein the selected award enhancement is a second multiplier.

12. The method of claim 11, wherein the enhancing step comprises one of adding the second multiplier to the first multiplier or multiplying the second multiplier by the first multiplier.

13. The method of claim 8, wherein the selected gaming device and the selected award enhancement are randomly selected.

14. A method of operating a wagering game comprising:

detecting an occurrence of a triggering event;

in response to the triggering event, selecting an award enhancement from a plurality of available award enhancements;

selecting a recipient gaming device from a plurality of gaming devices in a gaming system;

determining an individual award for the recipient gaming device; enhancing the individual award with the selected award enhancement; determining a community award for the gaming system; and determining a total award for the recipient gaming device, the total award being a function of the enhanced individual award and the community award.

15. The method of claim 14, wherein the individual award is a first multiplier and the selected award enhancement is a second multiplier.

16. The method of claim 15, wherein the enhanced individual award is a third multiplier, wherein the third multiplier equals wither the sum or the product of the first and second multipliers.

17. The method of claim 16, wherein the community award is a credit amount.

18. The method of claim 17, wherein the total award equals the credit amount multiplied by the third multiplier.

19. The method of claim 14, wherein the recipient gaming device is randomly selected.

20. The method of claim 14, wherein the selected award enhancement is randomly selected.

21. The method of claim 14, wherein the individual award is a function of (i) a rate of play of the recipient gaming device, (ii) a size of one or primary wagers received by the recipient gaming device, or both (i) and (ii).

22. A gaming system comprising:

at least one wager input device;

a plurality of gaming devices each displaying at least one primary wagering game;

a community display for displaying a community game;

at least one controller operative, in response to a triggering event, to:

(i) determine which of the plurality of gaming devices are eligible for participation in the community game;

(ii) determine an individual award enhancement for each of the eligible gaming devices;

(iii) determine a community award in the community game;

(iv) select an individual enhancement booster from a plurality of available individual award enhancement boosters;

(v) select one of the plurality of gaming devices to receive the selected individual enhancement booster; and (vi) if the selected gaming device is eligible for participation in the community game, boost the determined individual enhancement for the selected gaming device with the selected individual enhancement booster.

23. The gaming system of claim 22, wherein the individual enhancement or the individual enhancement booster is a multiplier.

24. The gaming system of claim 23, wherein the multiplier is determined as a function of (i) rate of play of the at least one primary wagering game on at least one of the eligible gaming devices, (ii) the size of one or more primary wagers received via the wager input device, or both (i) and (ii).

* * * * *

UNITED STATES PATENT AND TRADEMARK OFFICE

CERTIFICATE OF CORRECTION

PATENT NO. : 8,303,394 B2
APPLICATION NO. : 12/740771
DATED : November 6, 2012
INVENTOR(S) : Englman et al.

It is certified that error appears in the above-identified patent and that said Letters Patent is hereby corrected as shown below:

In the Claims:

In column 18, line 5 (Claim 22), please delete "award".

Signed and Sealed this
Sixteenth Day of July, 2013

Teresa Stanek Rea
*Acting Director of the United States Patent and Trademark Office*